US007743434B2

(12) United States Patent
Kaule

(10) Patent No.: US 7,743,434 B2
(45) Date of Patent: Jun. 29, 2010

(54) ECCENTRIC HINGE FOR PLUMBING FIXTURE

(75) Inventor: Brian M. Kaule, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 1085 days.

(21) Appl. No.: 11/391,523

(22) Filed: Mar. 28, 2006

(65) Prior Publication Data

US 2007/0226883 A1 Oct. 4, 2007

(51) Int. Cl.
*A47K 13/12* (2006.01)

(52) U.S. Cl. ..... 4/236; 4/240

(58) Field of Classification Search ..... 4/234–241; 16/387, 389, 225

See application file for complete search history.

(56) References Cited

U.S. PATENT DOCUMENTS 1,718,482 A * 6/1929 Myers ..... 4/240
2,153,734 A * 4/1939 Westrope ..... 16/372
2,215,088 A * 9/1940 Soss ..... 16/392
2,309,001 A 1/1943 Nave et al.
3,790,969 A 2/1974 Waldon
4,314,382 A * 2/1982 Ginsburg et al. ..... 4/240
4,993,109 A * 2/1991 Stevens ..... 16/390
5,450,633 A * 9/1995 Semmler ..... 4/240

FOREIGN PATENT DOCUMENTS

CH 550 921 A 6/1974
DE 93 10 259 U1 9/1993
WO PCT/US01/44610 6/2001

* cited by examiner

*Primary Examiner*—Khoa D Huynh
(74) *Attorney, Agent, or Firm*—Quarles & Brady LLP

(57) ABSTRACT

A multi-part eccentric hinge assembly for a plumbing fixture has two hinge bodies, which when connected pivotally couple a movable part of the fixture to a fixed part, for example, a lid or cover to a bowl deck. One of the hinge bodies has a radial portion and an offset portion. The radial portion generally extends along a line intersecting a pivot axis from a connection for pivotally connecting the hinge assembly to the plumbing fixture. The offset portion intersects the radial portion at one side of the pivot axis and extends back toward an opposite side of the pivot axis to a free end that connects to the second hinge body by a connector. The single hinge body is integrally formed with the moveable part so that the follows an eccentric path when the hinge body is pivoted about the pivot axis.

9 Claims, 4 Drawing Sheets

FIG. 2
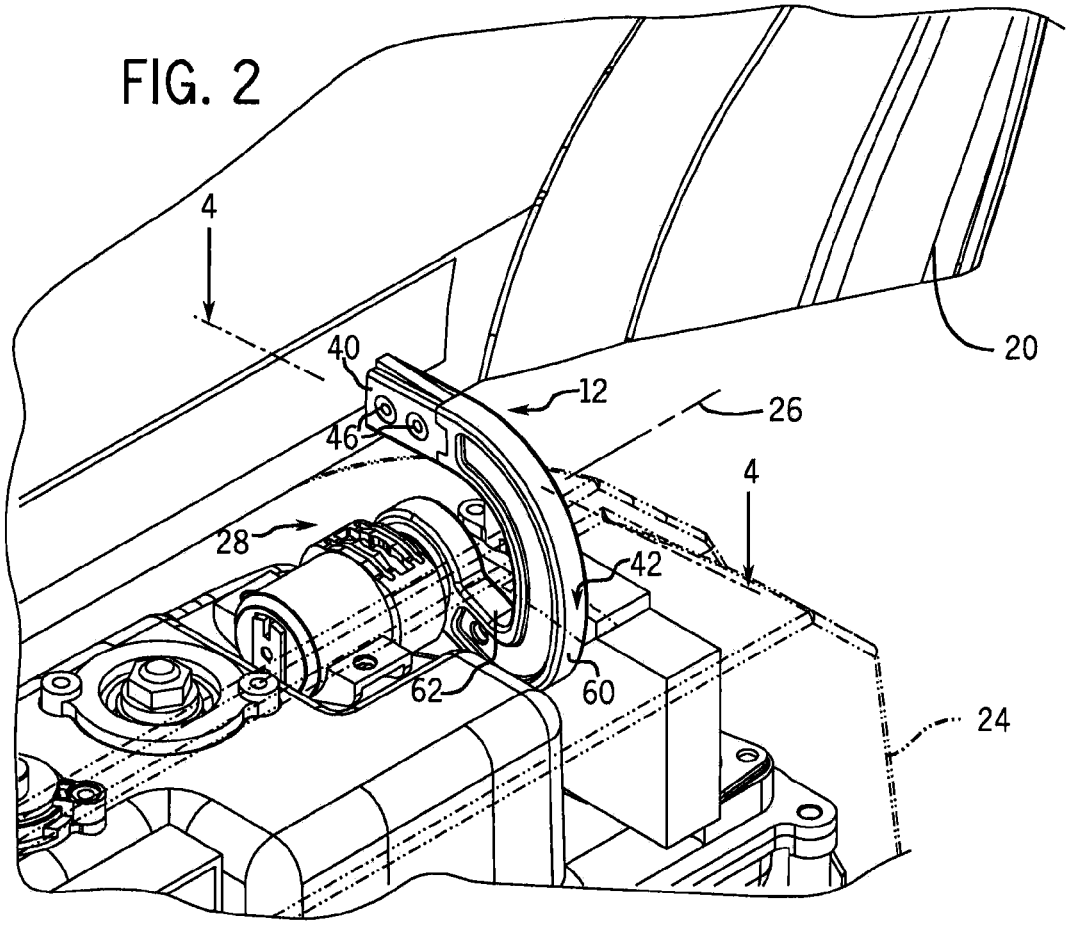
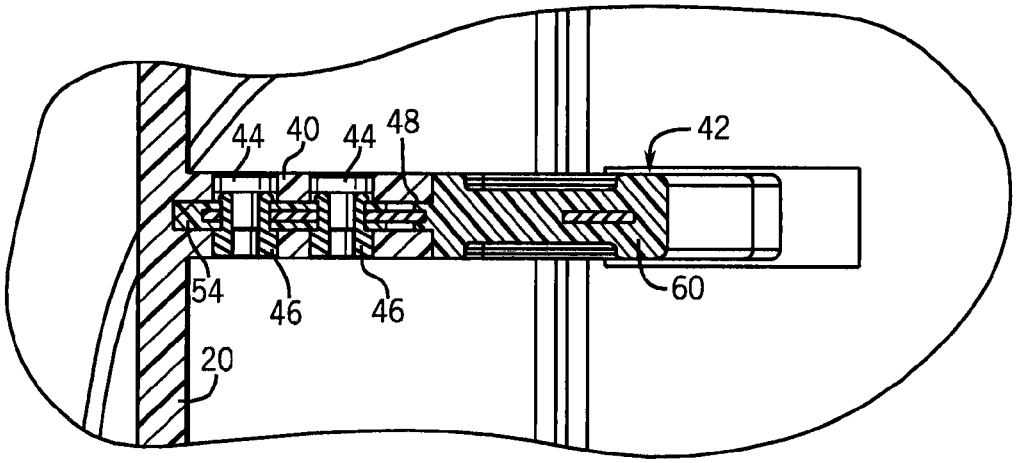
FIG. 4

ECCENTRIC HINGE FOR PLUMBING FIXTURE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to hinge structures for attaching movable parts to plumbing fixtures. More particularly it relates to a multi-part eccentric hinge assembly for connecting a seat, cover or the like to a plumbing fixture.

Plumbing fixtures such as bidets and toilets for cleaning and eliminating waste are well known. It is also well known for such fixtures to have a bowl holding plumbing water and a seat placed on the bowl for sitting on during use. The seat is typically pivotally attached to the bowl to allow it be moved out of the way, as when cleaning the bowl for example. To prevent objects from falling into the bowl, the seat is also often covered by a lid or seat cover that lies above the seat. Like the seat, the seat cover can be pivotally connected to the bowl.

Conventional seat and cover assemblies typically mount to the bowl by two bolts that fit through two openings in the rear deck of the bowl. A common hinge or two separate hinges connect the seat and cover to the mounts so that the cover or cover and seat can be pivoted up off of the bowl. In such conventional assemblies the hinges are exposed and somewhat unsightly. They also become a location where debris and urine can collect, thus making it more difficult to clean the fixture.

In certain fixtures, the location of the seat pivot axis is displaced from that of the cover. This can be to avoid the aesthetic and cleanliness problems associated with exposed hinges, or for other reasons, for example to accommodate raised rear deck areas of the bowl that contain washing controls and other features. Concealing the pivot axis presents other complications. Since the hinge must connect the seat cover, for example, to the bowl, the hinge arm must extend through an opening in the structure that conceals the pivot axis, usually a plastic housing mounted over the rear deck. If conventional straight hinges were used, the openings in the housings would have to be oversized, for example long slots, to permit the cover to pivot 90 degrees or slightly more as need to open and close the cover. Oversized openings like this create gaps into which object can fall and debris and liquids can collect. This problem has been overcome by using eccentric hinges, for example as taught in U.S. Pat. No. 5,450,633. As disclosed therein, such hinges can have a complex configuration, such as bent-back "U" or "C" shape, that allows the free ends of the hinges to follow a non-circular arc as the other ends pivot about the pivot axis. Such hinges can pivot 90 degrees or more through openings sized only slightly larger than the dimension of the hinge arm, thereby alleviating the aforesaid problem.

An additional complication with such concealed hinge arrangements pertains to manufacturing and assembly. To reduce assembly time and create a solid feeling connection at the seat cover, it is beneficial to form the hinge and seat cover as one piece, as in U.S. Pat. No. 5,450,633. However, assembling the hinges to a concealed pivot axis then becomes difficult. Either the pivot ends of the hinges have to be slid down through the narrow openings and somehow blindly connected to the pivots, or the openings in the housing must be open-ended, which again raises dirt collection issues.

Hence, a need exists to provide eccentric hinges for use in concealed pivot axis arrangements that can be more easily assembled to plumbing fixtures.

SUMMARY OF THE INVENTION

The invention provides an eccentric hinge for connecting a seat or lid to the bowl of a plumbing fixture, such as a toilet or a bidet. The configuration of the hinge allows the upper end of the hinge to be connected to the seat or lid while the other end is connected along the pivot axis concealed within an enclosed body. Its bent-back, offset configuration provides for eccentric pivotal motion so that the length of the slots in the enclosed body accommodating the hinges are minimized. The multi-part construction eases assembly with the connection points being easily accessed and viewed.

Specifically, the invention provides a hinge assembly for a plumbing fixture. The hinge assembly has at least two hinge bodies. One hinge body has a radial portion and an offset portion. The radial portion extends generally along a line intersecting a pivot axis and has a connection for pivotally connecting the hinge assembly along the pivot axis to a fixed part of the plumbing fixture. The offset portion intersects the radial portion at one side of the pivot axis and extends back toward an opposite side of the pivot axis to a free end. For example, the offset portion can be curved and follow a bend of approximately 90 degrees between the radial portion and the free end. As mentioned, this configuration causes the free end to follow an eccentric path as the first hinge body is pivoted about the pivot axis. The second hinge body is connectable at one end to a movable part of the plumbing fixture by a connector.

In one form, the two bodies of the hinge assembly are joined in a tab and slot type connection in which the second hinge body defines a pocket receiving the free end of the first hinge body. One pin, or preferably two pins, can be used to join the two parts by aligning through holes in each part and inserting the one or two pins in the hole(s). Any suitable rivets, bolts, screws, cotter pins or other such elongated structures could be used to secure the two components. To further solidify the connection, the two parts of the hinge can have mating edge surfaces, such as an angled shoulder on male the free end of associated hinge body and a complementary edge surface at the female end of the other hinge body.

In another form, the associated hinge body can be formed as a unitary part of the movable part of the plumbing fixture. This provides a solid, seamless connection between the hinge and the movable part of the fixture, while facilitating assembly of the hinge to the fixture by allowing the bent part of the hinge to be assembled to the pivot before the movable part is connected.

Other advantages of the invention will be apparent from the detailed description which follows and accompanying drawings. What follows is merely a description of a preferred embodiment of the present invention. To assess the full scope of the invention the claims should be looked to as the preferred embodiment is not intended to be the only embodiment within the scope of the claims.

BRIEF DESCRIPTION OF THE DRAWINGS

FIG. 2 is an enlarged partial perspective with housing structure removed to reveal one of the hinge assemblies;

FIG. 4 is a sectional view taken along line 4-4 of FIG. 2 showing the connection of the two arms of the hinge assembly shown in FIG. 2;

DETAILED DESCRIPTION OF THE PREFERRED EMBODIMENT

Figure 1:
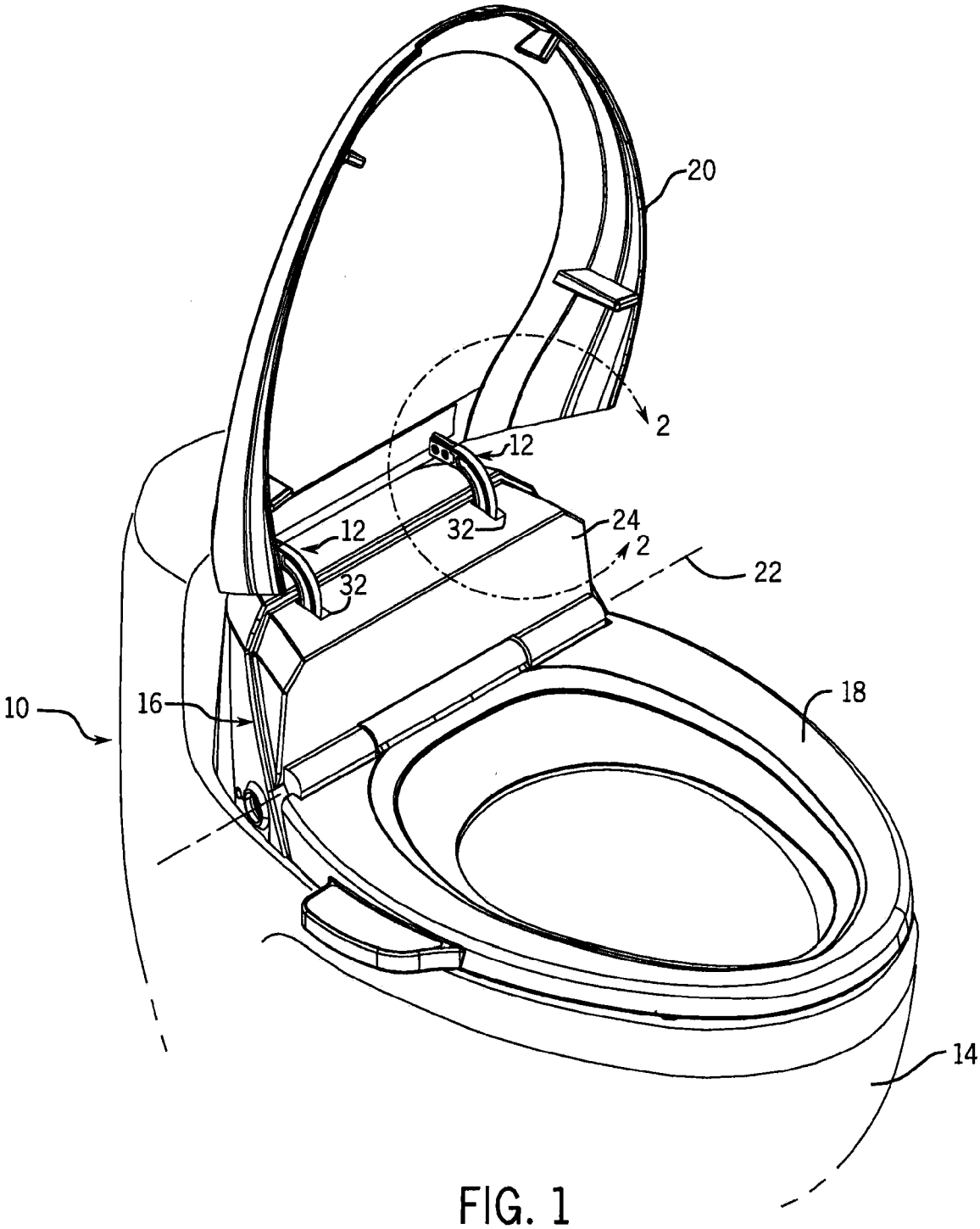
FIG. 1 is a partial perspective view of a plumbing fixture in the form of a bidet having multi-part eccentric hinge assemblies according to the present invention for pivotally mounting a seat cover.
Figure 3:
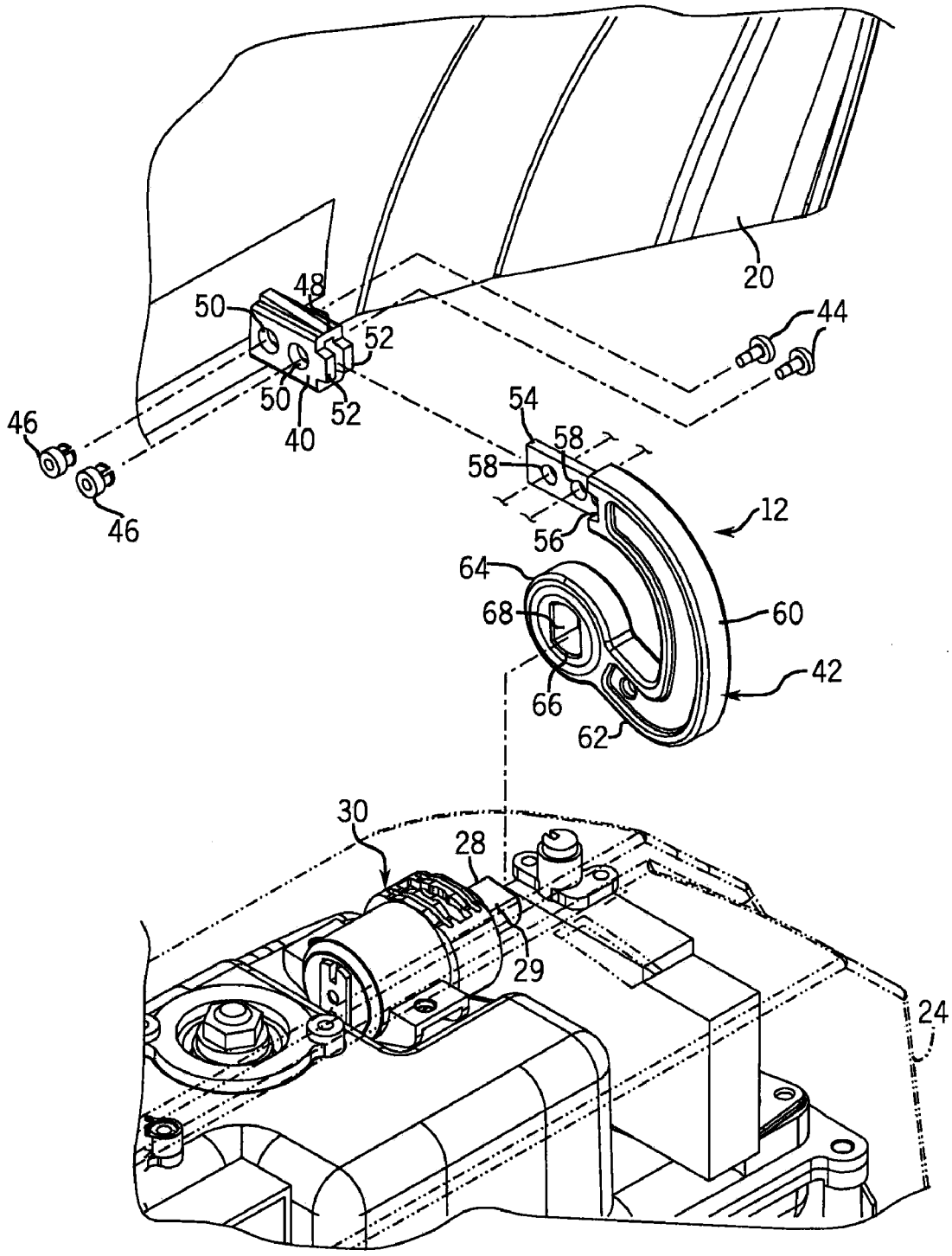
FIG. 3 is an exploded assembly view thereof.

FIG. 1 illustrates an exemplary plumbing fixture 10 employing a pair of eccentric hinge assemblies 12 according to the present invention. The fixture 10 is shown as a bidet, however, it could be a toilet or any other plumbing fixture having a bowl 14. A seat and cover assembly 16 is mounted to sit atop the bowl 14. The assembly 16 includes a seat ring 18, contoured for comfort, that encircles the top opening of the bowl 14. The seat ring 18 is covered by a seat cover 20 that closes off the openings of the seat ring 18 and the bowl 14. The seat ring 18 and seat cover 20 are each pivotally mounted to the bowl 14. The seat ring 18 is connected along pivot axis 22 by pivots at a housing body 24 mounted to a back deck of the plumbing fixture 10 so that the seat ring 18 can lay flat against the bowl rim as shown or be pivoted up past vertical where it can be propped up against the housing body 24. The seat cover 20 is connected by hinge assemblies 12 along pivot axis 26, as shown in FIG. 2, which is disposed vertically above the seat ring pivot axis 22 concealed within the housing body 24. The pivot for the seat cover 20 can be a singe or multiple rotatable pins for manual pivoting of the seat cover 20, or as shown in FIGS. 2 and 3, it can be the rotatable shaft 28 (with one or more keys or flat surfaces 29 preventing anti-rotation between the shaft and the hinge) of one or more motor and gear assemblies 30 (one shown) for motorized operation of the seat cover 20.

The eccentric hinge assemblies 12 allow the seat to lay against the seat ring 18 and pivot upward past vertical about the elevated and concealed pivot axis 26 without the need to oversize the slots 32 in the housing body 24 through which the hinge assemblies pass to connect the seat cover 20. Keeping the size of these slots 32 as small as possible reduces the chance that items will fall into the housing body 24 and also reduces the area for debris and liquids to collect. However, small slots can make assembling the seat cover 20 to the plumbing fixture 10 difficult, particularly when the arms of the hinge assemblies are permanently or integrally joined with the seat cover, such as if molded as a unitary part of the seat cover, which is desirable to achieve a solid connection to the seat cover. In such cases, the hinge assemblies would need to be assembled with the housing body in place, thus making it challenging to slide the hinges onto the pivots and fasten them in place though the slots in the housing body.

The present invention remedies this problem by making the hinge assemblies in multiple parts. The construction of the hinge assemblies 12 will be now be described with reference to FIGS. 2-4. For simplicity and clarity, only one of the two identical hinge assemblies will be described in detail.

Each hinge assembly includes a short receptor arm 40, a main arm 42 and a pair of connectors with pins 44 and nuts 46. The receptor arm 40 is formed as an integral part of the seat cover 20, for example being molded together with the seat cover during manufacturing. The receptor arm 40 defines a internal pocket 48 opening at it free end and has two sets of transverse holes 50 intersecting the pocket 48. The free end of receptor arm 40 is has small projections 52, which can be multi-sided tabs shown in FIG. 3. The receptor arm 40 connects to the free end of the main arm 42. Specifically, the free end of the main arm 42 has a tongue 54 of decreased dimension that fits into the pocket 48. When the main arm 42 is fully seated in the receptor arm 40, notches 56 in the shoulder of the main arm 42 interlock with the projections 52 in the receptor arm 40 and transverse holes 58 in the tongue 54 align with the holes 50 so that the pins 44 can be fastened to the nuts 46 to join the two arms together. The lengthwise contact of the tongue and pocket connection as well as the pin connectors and the interlocking projections make this connection solid with very little relative movement between the arms.

Figure 5:
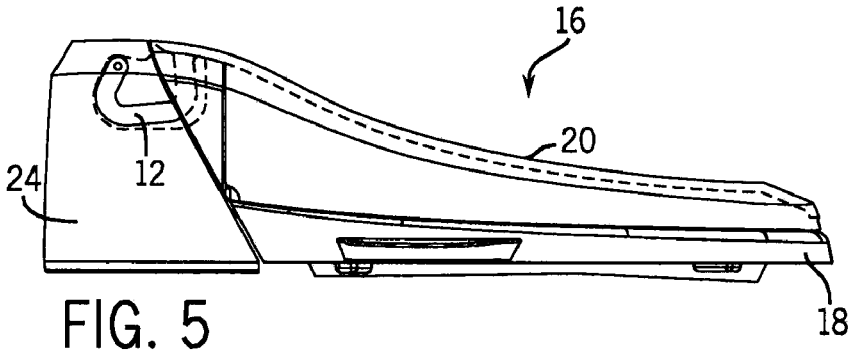
FIG. 5 is a simplified side elevational view showing the seat cover closed.
Figure 6:
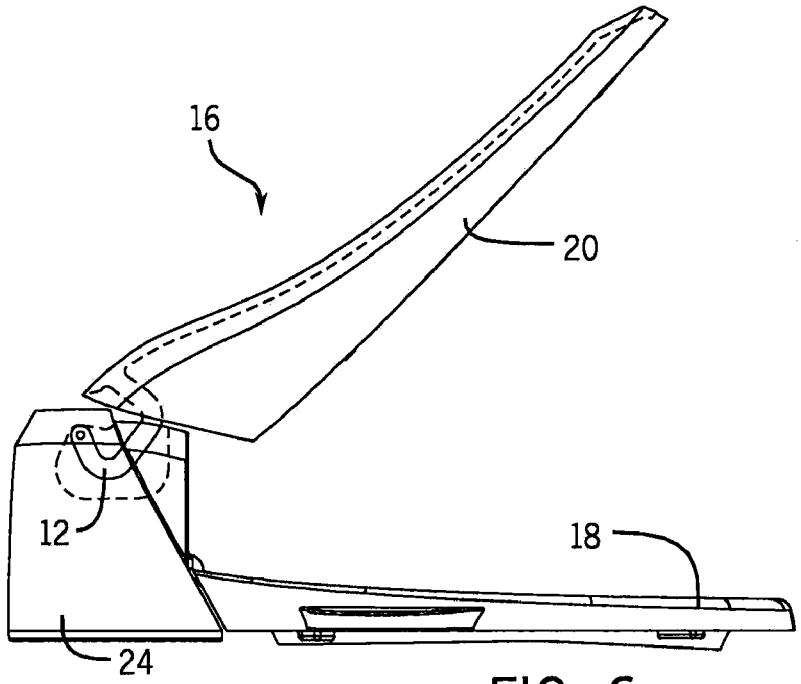
FIG. 6 is a similar view showing the seat cover opened mid-way.
Figure 7:
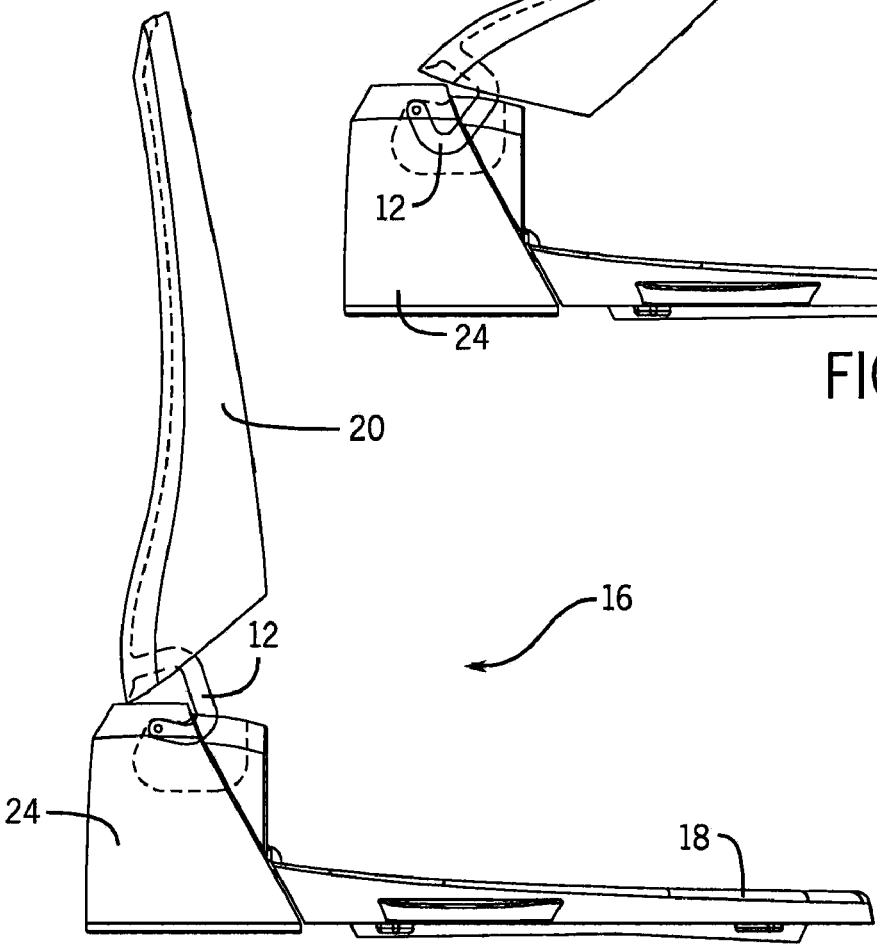
FIG. 7 is a similar view showing the seat cover fully open.

The rest of the main arm 42 includes an offset portion 60, a radial portion 62 and a hub 64 having an opening 66 keyed to fit on the pivot shaft 28 with flats 68 that corresponding to flats 29 of the shaft 28. The radial portion 62 extends essentially straight out from the hub 64 a short distance and intersects with the offset portion 60, which extends from the radial portion 62 to the tongue 54. The offset portion 60 follows a convex curved path backwards about 90 degrees toward an opposite side of the pivot axis so that the radial 62 and offset 60 portions form a reverse "C" shape. As a result of this configuration, the free end of the hinge that is where the seat cover connects, follows an eccentric path as it is pivoted about the pivot axis 26 from closed to open positions as shown in FIGS. 5-7. The eccentric path of the hinge limits lengthwise travel of the main arm 42 (perpendicular to the pivot axis 26) and thereby decreases the length needed for the slots 32 in the housing body 24 as compared to that of a concentric hinge.

As mentioned, assembly of the seat cover 40 to the plumbing fixture 10 is make easier by the multi-part hinges disclosed herein. The housing body 24 can be removed, or before it is installed, the main arms 42 of the hinges can be mounted to the pivot shafts 28 while in full view and able to be accessed by hand and with any necessary tooling. Before the receptor arms 40 are connected, the housing body 24 is installed, taking care to fit the main arms 42 through the slots 32. Then, after the housing body 24 is in place, the seat cover 20 is positioned in place with the receptor arms 40 fitting onto the tongues 54 of the main arms 42. The pins 44 and nuts 46 are then fastened together to mount the seat cover 20 to the hinges 12. This connection can also be made in full view and accessed by hand and tool since it is not concealed by the housing body 24.

While there has been shown and described what is at present considered a preferred embodiment of the invention, various changes and modifications can be made therein without departing from the scope of the invention defined by the appended claims. Therefore, various alternatives and revised embodiments are contemplated as being within the scope of the following claims.

INDUSTRIAL APPLICABILITY

The invention provides a multi-part eccentric hinge assembly for attaching a seat, seat cover or other pivotally mounted structure to a plumbing fixture for pivotal movement along a concealed pivot axis.

What is claimed is:

1. A hinge assembly for a plumbing fixture, comprising:

a first hinge body having a radial portion and an offset portion, the radial portion extending along a line intersecting a pivot axis and having a connection for pivotally connecting the hinge assembly along the pivot axis to a fixed part of the plumbing fixture, the offset portion intersecting the radial portion at one side of the pivot axis and extending back toward an opposite side of the pivot axis to a free end so as to follow an eccentric path as the first hinge body is pivoted about the pivot axis;

a second hinge body connectable at one end to a movable part of the plumbing fixture; and a connector joining the free end of the offset portion of the first hinge body to the second hinge body such that the first and second hinge bodies are joined in lengthwise contact, wherein the second hinge body defines a pocket receiving the free end of the offset portion of the first hinge body, and wherein the free end of the offset portion of the first hinge body has a notched shoulder that interlocks with a projection of the second hinge body.

2. The hinge assembly of claim 1, wherein the connector is a pin and wherein the second hinge body and first hinge body offset portion free end have openings that align when the first hinge body is connected to the second hinge body by the connector.

3. The hinge assembly of claim 2, wherein there are a pair of pins and a pair of openings connecting the first hinge body to the second hinge body.

4. The hinge assembly of claim 1, wherein the offset portion of the first hinge body is curved.

5. The hinge assembly of claim 4, wherein the offset portion bends approximately 90 degrees between the radial portion and the free end.

6. The hinge assembly of claim 1, wherein the second hinge body is formed as a unitary part of the movable part of the plumbing fixture.

7. The hinge assembly of claim 6, wherein the movable part is a seat cover.

8. The hinge assembly of claim 1, wherein the connection at the radial portion of the first hinge body is an opening (see 66) sized to receive a pivot post of the plumbing fixture.

9. The hinge assembly of claim 8, wherein the opening has a keyed flat surface for limiting relative relation between the first hinge body and the pivot post.

* * * * *

UNITED STATES PATENT AND TRADEMARK OFFICE

CERTIFICATE OF CORRECTION

PATENT NO. : 7,743,434 B2
APPLICATION NO. : 11/391523
DATED : June 29, 2010
INVENTOR(S) : Brian M. Kaule and James S. Giefer It is certified that error appears in the above-identified patent and that said Letters Patent is hereby corrected as shown below:

In the header of the patent change [Kaule] to --Kaule et al.--.

In the naming of the inventors add as a second inventor --and James S. Giefer, Sheboygan, Wisconsin (US)--.

Signed and Sealed this

Tenth Day of August, 2010

David J. Kappos

David J. Kappos
*Director of the United States Patent and Trademark Office*